US007347338B2

(12) United States Patent
Korpela

(10) Patent No.: US 7,347,338 B2
(45) Date of Patent: Mar. 25, 2008

(54) METHOD FOR CLOSING AND OPENING OF AN OPENING

(75) Inventor: Matti Korpela, Naantali (FI)

(73) Assignee: Bio-Nobile Oy, Turku (FI)

( * ) Notice: Subject to any disclaimer, the term of this patent is extended or adjusted under 35 U.S.C. 154(b) by 705 days.

(21) Appl. No.: 10/182,468

(22) PCT Filed: Feb. 12, 2002

(86) PCT No.: PCT/FI01/00124

§ 371 (c)(1),
(2), (4) Date: Jul. 29, 2002

(87) PCT Pub. No.: WO01/60967

PCT Pub. Date: Aug. 23, 2001

(65) Prior Publication Data

US 2003/0003023 A1 Jan. 2, 2003

(30) Foreign Application Priority Data

Feb. 16, 2000 (FI) ..... 20000335

(51) Int. Cl.
*B65D 39/12* (2006.01)

(52) U.S. Cl. ..... 215/361; 215/396; 215/355

(58) Field of Classification Search ..... 215/50, 215/51, 361, 296, 355; 210/222, 695; 436/526
See application file for complete search history.

(56) References Cited

U.S. PATENT DOCUMENTS 2,021,259 A * 11/1935 Magnuson ..... 215/361
3,842,790 A * 10/1974 Clark ..... 215/228
4,338,764 A 7/1982 Percarpio ..... 53/432
4,826,029 A * 5/1989 Skoglie ..... 217/110
5,846,489 A 12/1998 Bienhaus et al. ..... 422/62
5,957,822 A 9/1999 Bienhaus et al. ..... 493/100
6,403,038 B1 * 6/2002 Heermann ..... 422/101

FOREIGN PATENT DOCUMENTS

DE 37 03 875 8/1988
WO WO 99/42832 8/1999

* cited by examiner

*Primary Examiner*—Paul S Hyun
(74) *Attorney, Agent, or Firm*—James C. Lydon

(57) ABSTRACT

A method for opening an opening (10) using an elastic plug (2, 2') whose outside diameter in a static state ($r_L$), is larger than diameter ($r_p$) of opening (10), and which plug has a cavity (12) at its end. An extending device (4, 4') is inserted into plug cavity (12) so that the plug is tightly pressed around extending device (4, 4'). Plug (2, 2') is extended by inserting extending element (20) of extending device (4, 4') into plug cavity (12) so deeply that outside diameter ($r_V$) of plug (2, 2') is equal to, or smaller than, diameter ($r_p$) of opening (10). The extended plug is inserted into opening (10), and its extension is reduced such that plug (2, 2') closes opening (10) and adheres to it so tightly that extending device (4, 4') is detachable from plug (2, 2'). A method for opening the opening (10) when closed by plug (2, 2') is also disclosed.

21 Claims, 5 Drawing Sheets

METHOD FOR CLOSING AND OPENING OF AN OPENING

Figures 1A, 1B, 1C, 1D:
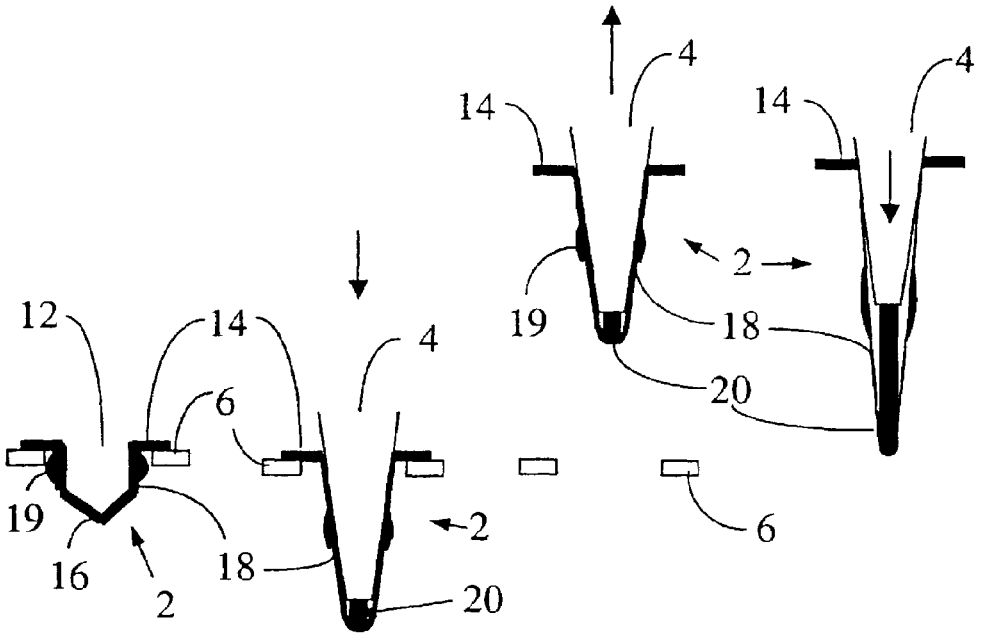

This application is a U.S. National Stage of International application PCT/FI01/00124, filed Feb. 12, 2001, and published on Aug. 23, 2001 in the English Language.

The present invention relates to a method for closing and opening an opening. The invention relates to a method especially suitable for laboratory use, particularly for applications of molecular biology, the method however being applicable for a plurality of very diverse purposes. The invention expressly discloses a method for closing and/or opening an opening by means of a plug or the like of elastic material, the outside diameter of which, in a static state, is larger than the opening to be closed.

There are quite a number of different alternatives for closing tubes and vessels. Traditionally, a tube can be closed with a plastic plug which is pressed or twisted into the mouth of the tube. The plug should be readily removable from the tube. Screwed plugs and tubes are not practical in case there is a plurality of tubes to be handled and the tubes are to be closed and opened several times within a short period of time. Furthermore, the closing of openings on the base of gluing or heat-closing is a case apart, in which opening of openings is performed by removing the glued closure from the opening or, particularly in case of a heat-sealed closure, by piercing it. As special cases, septum type solutions may be mentioned, in which liquid additions or removals can be performed by means of a sharp pointed syringe through the septum.

Tubes, as for instance so called Eppendorff tubes, can have a closure solution consisting of a plug fixed in the tube. This is a relatively simple solution for closing a tube. However, tubes with this kind of closing solution are not easy to use, because for opening a small and tightly closed tube, relatively strong effort is needed. Consequently, different devices for opening the plug of this type of tube have been developed. When working with these kinds of tubes, bursting plugs bring about problem situations due to splashings taking place in the opening step. These problems will be more pronounced, if tubes are to be closed and opened several times.

Reduced well sizes and simultaneous closing of a plurality of adjacent wells, as in the case of for instance 96 and 384 well microtitre plates, pose quite special requirements for closing the wells. Adhesive stamps, aluminium foils and silicon rubber cover sheets are used for closing the wells tightly. In some alternatives, special devices will be needed for closing and opening the plates, and in other alternatives, closing can be performed by simply pressing the cover sheet on the plate. The plates can be opened either by removing the cover from the plate or, in some cases (aluminium foil, for example), the membrane can be pierced at the spot of individual wells. Problems, however, are the risks of contamination between adjacent wells, formation of aerosols and difficulties in reclosing the wells. Simple and careful closing and opening are, also in this area, highly recommendable alternatives. An especially advisable alternative would be to be able to close and open individual wells in a well plate simply and safely.

A very challenging field utilising test tubes is provided by PCR (polymerase chain reaction) applications in molecular biology where contamination risks substantially increase, if the tubes/wells can not be opened in a controlled way. In PCR reactions and in situ applications thereof, also high temperatures and refrigeration are used. This causes further requirements for closing tubes, wells and vessels. In these processes very high temperatures (commonly from 90° C. to 95° C.) are used and, pressure will generate in the closed vessel. Consequently, a method for closing a reaction vessel tightly is needed, which also allows for easy opening thereof.

In general, it would be preferable if closing and opening vessels and wells could be executed in a simple, safe and careful manner. An especially great advantage would be provided by solutions in which a number of openings of various sizes could be closed with one closure. A solution of opening and closing wells, which could be easily automatised, would be extremely important in terms of both production and treatment of large sample series.

The U.S. Pat. No. 5,846,489 describes a hollow cap for closing vessels. The cap is preferably manufactured from thermostable plastic, such as polystyrene, or polypropylene. The patent also describes a means for removing the cap from the mouth of a vessel. According to the invention, the means is used for removing the cap from the mouth of the vessel. The invention decribes the cap as prefererably having a special double layer, because in that case, when inserting the means into the cap, the cap does not extend sideways in respect to the inner wall of the vessel. The invention also discloses a cap which does not have the double layer mentioned above, and this embodiment is said to be not preferable. In this case, the means for removing the cap unpreferably extends the cap and the holding power of the vessel regarding the cap is further increased which makes the removal more difficult. The holding power between the means for removing the cap and the cap according to the invention must be greater than the holding power between the cap and the vessel. This poses extreme requirements to the manufacture of both the vessel and the cap according to the invention.

The U.S. Pat. No. 5,282,543 discloses a cover manufactured from flexible material for simultaneous closing a plurality of vessels. The cover described in this patent has a plurality of nodules, each of them closing one individual vessel. The patent does not describe any device for closing and/or opening a vessel. The U.S. Pat. No. 5,056,427 also describes a cover of flexible material for closing a plurality of vessels simultaneously. This invention also utilises nodules, but on the other side of the cover in respect of the mouths of the vessels to be closed. The patent describes the use of the cover together with a weight pressing the cover tightly into the mouths of the vessels.

The invention according to the present application is aimed at offering a new solution for closing and opening different kinds of openings with which many of the aforementioned problems will be controlled better than with known methods. The intention is to provide a method enabling closing and/or opening different kinds of openings, for instance openings of test tubes, vessels, flasks, holes, and storage packings, easily and effectively.

To accomplish the aforementioned purposes, a method according to the invention for closing an opening by means of a plug or the like of elastic material, the outside diameter of the plug, in a static state, being larger than the opening to be closed, and which plug has, at its end, a cavity and potentially a flange or a similar protruding portion, the diameter of which is substantially larger than that of the opening to be closed, is characterised in that a) an extending device for the plug is attached to the plug i) by inserting the extending device into the cavity of the plug so deep that the plug is pressed around the extending device so tightly that the plug, when being extended, remains in an extended state around the extending device, or ii) by gripping the flange, the protruding portion, the groove or the like of the plug with a gripping means of the extending device, b) the plug is extended by inserting the extending element of the extending device into the cavity of the plug so deep, that the outside diameter of the plug is equal to or smaller than the diameter of the opening to be closed, c) the extended plug attached to the extending device is inserted into the opening to be closed, and d) the extending is reduced to such an extent that the plug closes the opening and adheres to it so tightly that the extending device is removable from the plug i) either by pulling, or ii) by means of a special removing element associated with the extending device.

To accomplish the aforementioned purposes, a method according to the invention for opening an opening closed by means of a plug or the like of elastic material, the outside diameter of the plug, in a static state, being larger than that of the closed opening, and which plug has, at its end, a cavity and potentially a flange or a similar protruding portion, the diameter of which is substantially larger than that of the closed opening, is further characterised in that a) an extending device for the plug is attached to the plug closing the opening i) by inserting the extending device into the cavity of the plug so deep that the plug is pressed around the extending device so tightly that the plug, when being extended, remains in an extended state around the extending device, or ii) by gripping the flange, the protruding element, the groove or the like of the plug with a gripping means of the extending device, b) the plug is extended by inserting the extending element of the extending device into the cavity of the plug so deep, that the outside diameter of the plug is equal to or smaller than the diameter of the closed opening, c) the extended plug attached to the extending device is pulled out of the closed opening, and d) the extending is reduced to such an extent that the extending device is removable from the plug i) either by pulling, or ii) by means of a special removing element associated with the extending device.

In the following, the invention will be described in a more detailed way with reference to the accompanying drawings:

FIGS. 1*a-h* illustrate, as cross-sectional sideviews, the steps of a method according to an embodiment of the invention, in which steps the plug is at first detached by pressing with the extending device from a rack of plugs, the plug is then further extended by the extending device, the extended plug is then inserted into the test tube designed for it, extending of the plug in the mouth of the tube is ceased and the extending device is detached from the plug, and, finally, the extending device is inserted into the plug in the test tube again and the extended plug is removed with the extending device from the test tube.

FIGS. 2*a-h* illustrate, as cross-sectional sideviews, the steps of a method according to another embodiment of the invention, in which steps the plug is at first detached from a rack of plugs by pressing with the extending device, then the plug is further extended by the extending device, the extended plug is then inserted into the opening to be closed, extending of the plug in the sealed mouth of the tube is ceased and the extending device is detached from the plug, and, finally, the extending device is inserted again into the plug in the opening and the extended plug attached to the extending device is removed from the opening.

Figure 3A:
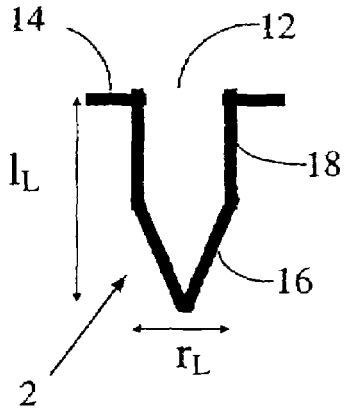
Figure 3B:
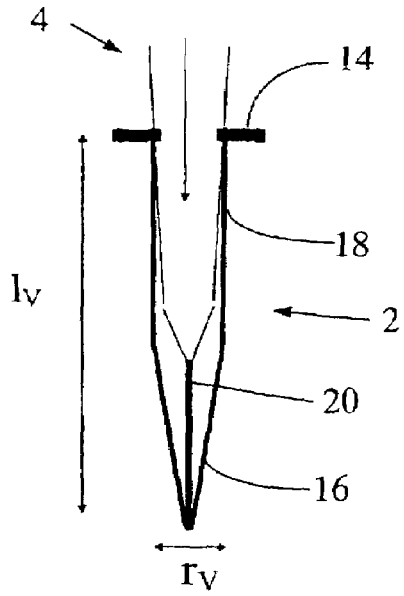
Figure 3C:
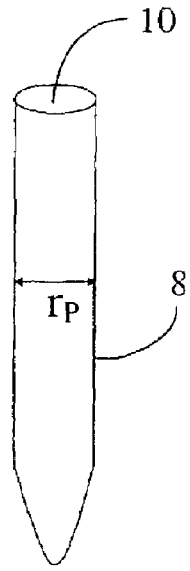

FIGS. 3*a-c* illustrate, as cross-sectional sideviews, changes in respect to the diameter of the test tube mouth caused by the extension of the length and the diameter of the plug to be used for closing a test tube in an embodiment of the method according to the invention.

Figure 4A:
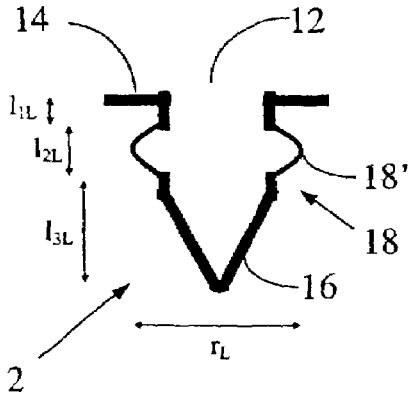
Figure 4B:
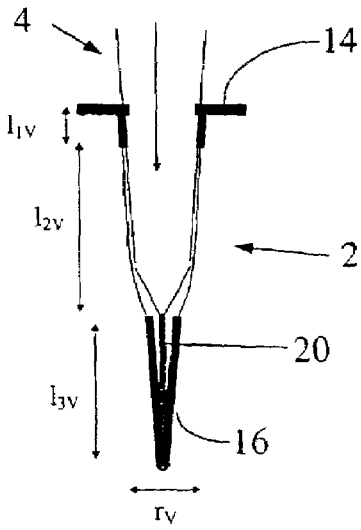

FIGS. 4*a-b* illustrate, as cross-sectional sideviews, changes caused by the extension of the plug to be used in another embodiment of the method according to the invention, and of the length of its different parts and its diameter, in respect to each other.

FIGS. 5*a-d* illustrate, as cross-sectional sideviews, the steps of an embodiment of the method according to the invention, in which steps the extending device is inserted into a plug designed for closing an opening in a wall, the plug is further extended with the extending device, the plug in inserted into the opening in the wall and the extending device is detached from the plug in the opening.

FIGS. 6*a-l* illustrate, as cross-sectional sideviews, the steps of a method according to an embodiment of the invention, in which embodiment the extending device is used, not only for extending the plug so as to close or open an opening, but also as a transferring device designed for transferring magnetic particles from one vessel to another, and the plug is used, in addition to closing the vessel, as an extending membrane separating the magnet of said transferring device from magnetic particles to be transferred.

In the present application, openings mean any kinds of openings. Openings include orifices/mouths of vessels used in laboratories, such as test tubes, flasks and the like, as well as e.g. mouths of wells in a microtitre plate. Vessels can include e.g. an individual test tube, a well, an array of wells, a microtitre plate or a piece especially designed for a special purpose. A vessel can be manufactured from e.g. polystyrene, polypropylene, polyethylene, polycarbonate, or glass. Further, openings include mouths of other vessels as well, such as mouths of different containers or transfer tanks. They can even include openings of vessels and packages for storing and/or shipping of foodstuff and/or other goods. Further, openings of different kinds of containers, such as filling holes, discharge openings and inspection openings, are openings intended in this application. Further, openings can include air vents of vessels and containers, or the like.

Openings can also include holes in walls and bulkheads other than vessel walls, the closing and opening of which are advantageously performed by the method according to the invention. Even holes made in a wall for leading through of different kinds of pipes, cables and conductors, or for fixing a bracket or a clamp on a wall, are openings intended in this application. In the previous case, a plug with which the opening is closed or with which the opening to be opened is closed is designed to be suitable for both the method according to the invention and for the above mentioned special purpose. In case of buildings, a wall can even mean the floor or ceiling.

In this application, a plug means any object that can be used for closing an opening. The plug can be intended not only for closing a mouth of a vessel, such as a vessel used in laboratories, and different kinds of vessels and containers used for storing and shipping, as described above in connection of openings, but it can also be intended solely or additionally for another special purpose. These purposes may include for example those expressed above in connection with openings, e.g. applicability for fixing an object, for instance a bracket or a clamp, or for leading through a pipe or a conductor. An elastic plug means, in this patent application, that the plug is manufactured from a material such that it is elastic, in particular when being extended, and that it substantially retrieves its original shape, when the force influencing its shape, particularly extension, ceases to influence. The elasticity of the plug can be achieved by appropriate choice of material of the plug or of its parts. Especially suitable material include elastomeric materials, such as silicone rubber, caoutchouc, fluorosilicon, fluoroelastomers, perfluoroelastomers, polyurethane, polychloroprene, styrene butadiene, and ethylene propylene.

A cavity at the end of the plug means especially a cavity at the plug end situated on that side of the plug by which the plug is manually inserted into and/or removed from the opening. Further, the cavity of the plug is such that in between the casing of the plug and the cavity, which is typically of conical or cylindrical shape, remains a wall typically tubular in shape.

In this application, the outside diameter of the plug and the diameter of the opening to be closed mean, respectively, the outside diameter of the cross-section of the plug and the inside diameter of the opening to be closed, which are unambiguous as the plug and the opening are substantially circular in cross-section. In case the cross-section of the plug or the opening are not substantially circular, the diameter means the dimension of the plug in a direction or directions which, the plug being in a static state, is/are larger than the corresponding dimension or dimensions of the opening to be closed.

Figures 1E, 1F, 1G, 1H:
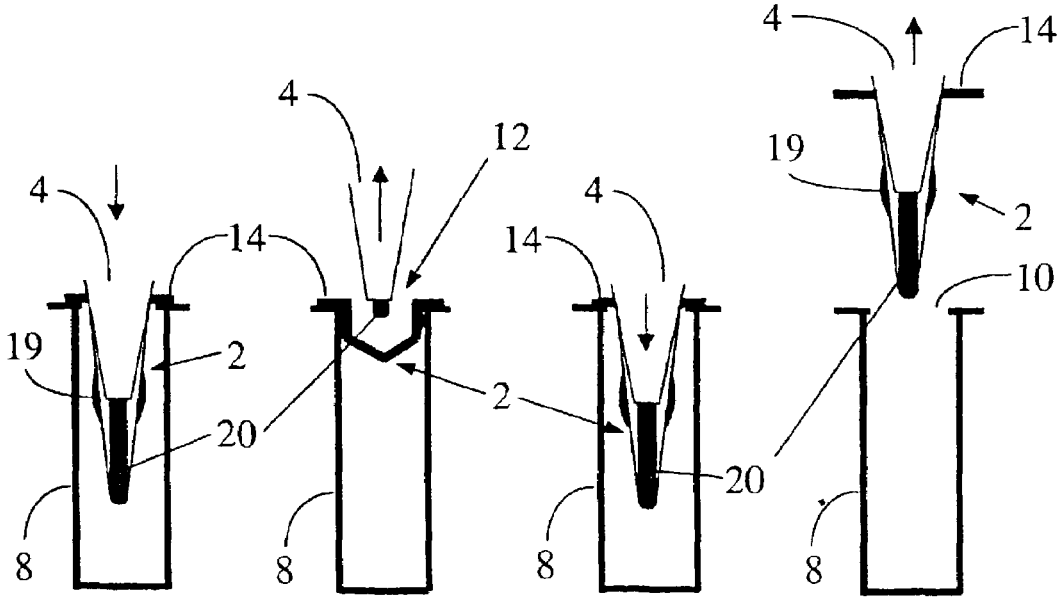
Figures 2A, 2B, 2C, 2D:
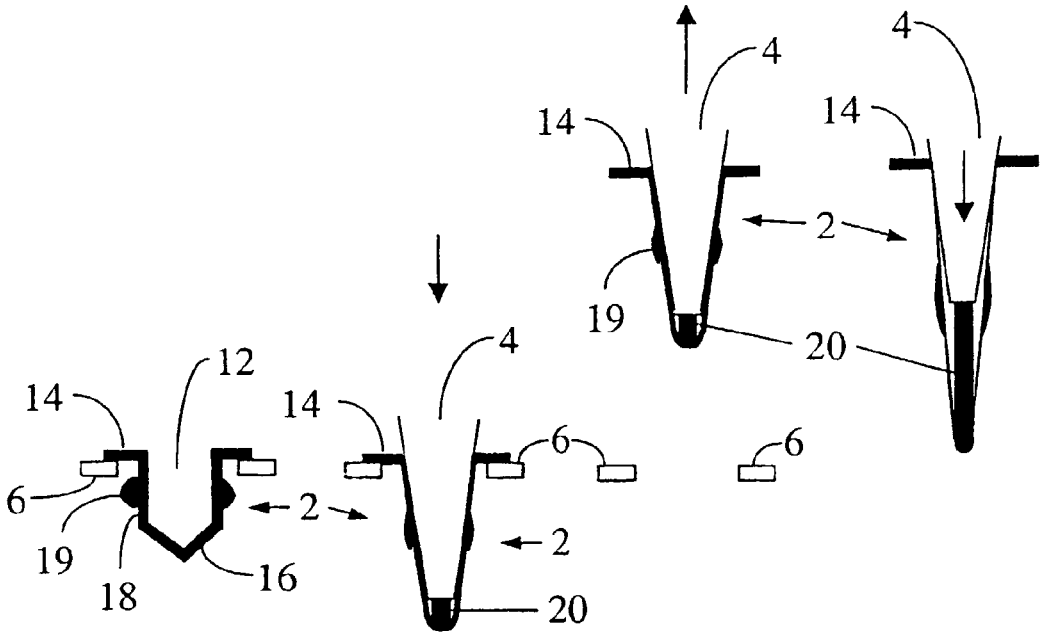
Figures 2E, 2F, 2G, 2H:
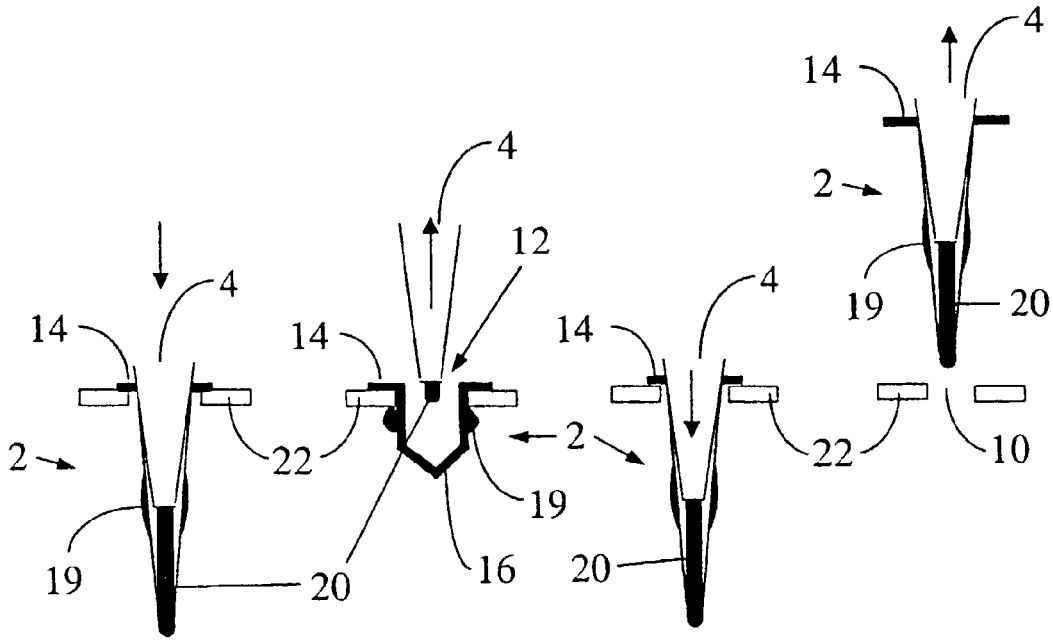

FIGS. 1*a*-1*h* illustrate steps of an embodiment of the method according to the invention, and FIGS. 2*a*-2*h* illustrate steps of another embodiment of the method according to the invention, in which steps 1) the plug 2 is removed from the plug rack 6 by pressing with the extending device 4 (FIGS. a-c),
2) the plug 2 is further extended by the extending device 4 (FIG. d),
3) the extended plug 2 is inserted into an object (FIG. e) which, in FIG. 1, is a mouth 10 of a test tube 8 or a corresponding vessel, and in FIG. 2 an exactly undefined opening 10 in a wall,
4) the extending of the plug 2 in the mouth 10 of the test tube 8 (FIG. 1*f*) or in the opening 10 (FIG. 2*f*) is ceased and the extending device 4 is detached from the plug 2 (FIG. f),
5) the extending device 4 is inserted again into the plug 2 in the mouth 10 of the test tube 8 (FIGS. 1*e*-1*h*) or in the opening 10 (FIGS. 2*e*-2*h*), and the extended plug 2 is removed by the extending device 4 from the mouth of the test tube 8 (FIGS. 1*g*-1*h*), or from the opening 10 (FIGS. 2*g*-2*h*).

In FIGS. 1*a* and 2*a*, the plug 2 is in a plug rack 6. The plug 2 of both FIG. 1 and FIG. 2, has, at one end, a cavity 12 and a flange 14 which is substantially larger than the opening 10 to be closed, and the other end 16 of the plug is, in a static state, conical in shape. The flange 14, at one end, and the other, conical end 16 are connected with each other by a central portion 18 which is, in a static state, cylindrical in shape. In FIG. 1 the tube 8 has a special collar at the level of the tube mouth 10, under which an amplification 19 in the cylindrical central portion 18 of the plug 2 remains and thereby seals the plug 2 tightly into the mouth 10 of the tube 8. The plugs 2 in FIGS. 1 and 2 are very similar, but the wall thickness of the amplification 19 situated in the middle of the cylindrical central portion 18 of the plug 2 of FIG. 2 is greater than the corresponding thickness of the plug 2 of FIG. 1. The aim of the greater wall thickness of the amplification 19 is to enable the plug to even close tightly an opening 10 as that represented in FIGS. 2*g*-2*h*. In FIGS. 1*b* and 2*b* the tip of the extending device 4 has been connected with the plug 2 in the plug rack 6 by inserting the extending device 4 into the cavity 12 of the plug 2 in such a depth that the plug 2 is pressed around the extending device 4 so tightly that the plug 2, when being extended, remains in an extended state attached to the extending device 4. In FIGS. 1*c* and 2*c*, the plug 2 attached to the extending device 4 has been lifted from the plug rack 6. In FIGS. 1*d* and 2*d*, the plug 2 is extended by pushing the extending element 20 of the extending device 4 out of the tip of the extending device 4 against the bottom of the cavity 12 of the plug 2 to such an extent that the outside diameter of the plug 2 is smaller than the diameter of the opening 10 to be closed. In FIGS. 1*e* and 2*e*, the extended plug 2 attached to the extending device 4 is inserted into the opening 10 to be closed. In FIGS. 1*f* and 2*f*, extension has been reduced by pulling the extending element 20 back inside the extending device to such an extent that the plug 2 has closed the opening 10 and attached thereto so tightly that the extending device 4 has been able to be detached from the plug 2 by pulling. In FIGS. 1*g* and 2*g*. the extending device 4 has again been attached to the plug 2 closing the opening 10 by inserting the extending device 4 into the cavity 12 so deep that the plug 2 has been pressed around the extending device 4, and the plug 2 has been extended by inserting the extending element 20 of the extending device 4 into the cavity 12 of the plug 2. In FIGS. 1*h* and 2*h*, the plug 2 attached to the extending device 4 has been pulled out from the closed opening 10.

FIGS. 3*a* and 3*b* illustrate changes caused by extending the length 1 and the diameter r of the plug 2 intended for closing test tube 8 of the invention according to an embodiment, and FIGS. 4*a* and 4*b* illustrate corresponding changes in the plug 2 intended for closing an undefined opening, according to another embodiment. FIG. 3*c* represents the mouth 10 and the diameter $r_p$ of the test tube 8.

In FIGS. 3*a* and 4*a*, the plugs 2 are illustrated in a static state. The plugs are similar to those represented in FIGS. 1 and 2: the plugs have, at one end, a cavity 12 and a flange 14 which is substantially larger than the opening 10 to be closed, and the other end 16 is, in a static state, conical in shape. A cylindrical central portion 18 connects the flange 14, at one end, and the other conical end 16 with each other. In the middle of the cylindrical central portion 18 of FIG. 4, there is, however, differing from the plugs of FIGS. 1-3, a protrusion 18', the wall thickness of which is substantially thinner than the wall thickness of the other portions of the plug 2.

From FIGS. 3*a* and 3*c*, it is evident that the maximum diameter of a static state, $r_L$, of the parts 16, 18 of the plug 2 to be inserted into the mouth 10 of a test tube 8 is larger than the inside diameter $r_p$ of the test tube 8. FIG. 3*b* shows that once the plug 2 has been attached to the extending device 4 and the plug 2 is being extended by inserting the extending element 20 of the extending device 4 into the cavity 12 of the plug 2 deep enough so that the length of the plug is extended from the length $l_L$, of a static state, to the extended length $l_v$, the plug 2 is extended to that extent that the maximum extended diameter $r_v$ of the parts 16, 18 of the plug to be inserted into the mouth 10 of a test tube 8 is smaller than the inner diameter $r_p$ of the mouth of the test tube 8 to be closed.

FIGS. 4*a* and 4*b*, in their turn, show that the deformations caused by the extending of the plug 2 can be focused at a desired site in the plug 2 by choosing the wall thicknesses. In FIGS. 4*a* and 4*b*, the length of the plug 2 has been divided in three sections $l_1$, $l_2$, and $l_3$ such that the first section comprises the portion above the aforesaid protrusion 18', the second section comprises the area of the protrusion 18' and the third section comprises the portion beneath the protrusion 18'. Since the wall thickness of the protrusion 18' is smaller than that of the other portions of the plug 2, it extends, when being extended by the extending device 4, more than the other portions of the plug 2, as can be seen from FIGS. 4*a* and 4*b*. Then, the aforesaid lengths change from the static state L to the extended state V in such a manner that the change from the static length $l_{2L}$ of the protrusion 18' to its extended length $l_v$ is relatively much bigger than the change from the static length $l_{1L}$ of the portion above the protuberance to its extended length $l_{1v}$ or the change from the static length $l_{3L}$ of the portion above the protrusion to its extended length $l_{3v}$. The important elongation due to the smaller wall thickness of the protrusion exactly at the site of the protrusion of the plug 2 converges the protrusion, hence the maximum extended diameter $r_v$ of the portions 16, 18, 18' of the plug 2 to be inserted into the opening becomes, correspondingly, significantly smaller than the maximum static state diameter $r_L$. By choosing the wall thickness, it is possible to accentuate not only the changes of the dimensions $l_1$, $l_2$, and $l_3$ in the direction of extension, but also the changes of dimension r transversal in respect to the extension direction.

Figures 5A, 5B, 5C, 5D:
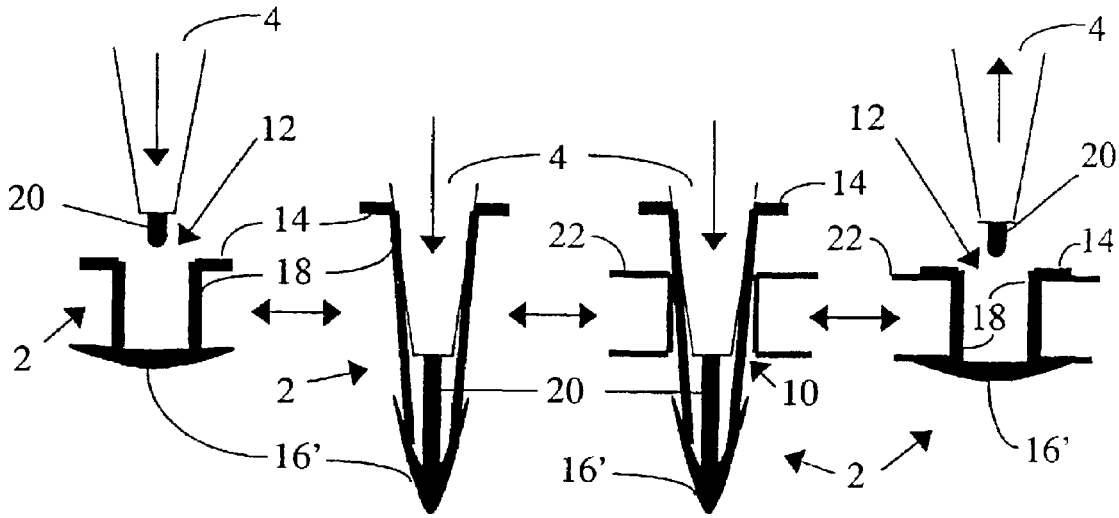

FIGS. 5*a*-5*d* illustrate the steps of a method according to an embodiment of the invention, in which steps 1) the extending device 4 is inserted into the plug 2 designed for closing the opening 10 in a wall 22 (FIG. 5*a*),
2) the plug 2 is extended by the extending device 4 (FIG. 5*b*),
3) the plug 2 is inserted into the opening 10 of the wall (FIG. 5*c*), and
4) the extending device 4 is detached from the plug 2 in the opening 10 (FIG. 5*d*).

The plug in FIG. 5*a* differs in shape from those illustrated in FIGS. 1-4: the plug 2 has, in one end, a cavity 12 and a flange 14 substantially larger than the opening 10 to be closed, as in previous embodiments, but unlike them, the other end 16' is in a static state discoidal and of a diameter substantially larger than the opening 10 to be closed. The ends 14, 16' of the plug are connected with each other by a cylindrical portion 18, the diameter of which is in a static state substantially equal to the diameter of the opening 10 to be closed. Depending on the application, the static diameter can even be larger or smaller than the diameter of the opening to be closed. In FIG. 5*b* the extending device 4 has been attached to the plug 2 by inserting the extending device 4 into the cavity 12 of the plug 2 to such a depth that the plug 2, when being extended, remains extended around the extending device 4, and the plug 2 has been extended by inserting the extending element 20 into the cavity 12 of the plug 2 to such a depth that even the outside diameter of the discoidal second end 16' of the plug 2 is equal to or smaller than the diameter of the opening 10 to be closed. In FIG. 5*c*, the extended plug 2, attached to the extending device 4, has been inserted into the opening to be closed on the wall 22. FIG. 5*d* represents a situation after the extension has been reduced by pulling the extending element 20 inside the extending device 4 to such an extent that the plug 2 has closed the opening 10 and attached to it so tightly that the extending device 4 can have been detached from the plug 2.

FIGS. 6*a*-6*k* illustrate steps of the method according to an embodiment of the invention, in which embodiment the extending device 4 is used, except for extending the the plug 2' in order to close and open the opening 10, even as a transferring device 4' for transferring magnetic or magnetisable microparticles or magnetic particles 24 binding an immobilised substance from a first vessel 26 to a second vessel 28, and where the plug 2' is used, except for closing the vessel 26, 28, even as an extendable membrane 2' separating the magnet 30 of said transferring device 4' from magnetic particles 24 to be transferred. The method and the plug 2' according to this embodiment of the invention thus consists of integration of the solutions according to the invention disclosed in the patent publication WO 99/42832 as a part of the present invention.

Figures 6A, 6B, 6C:
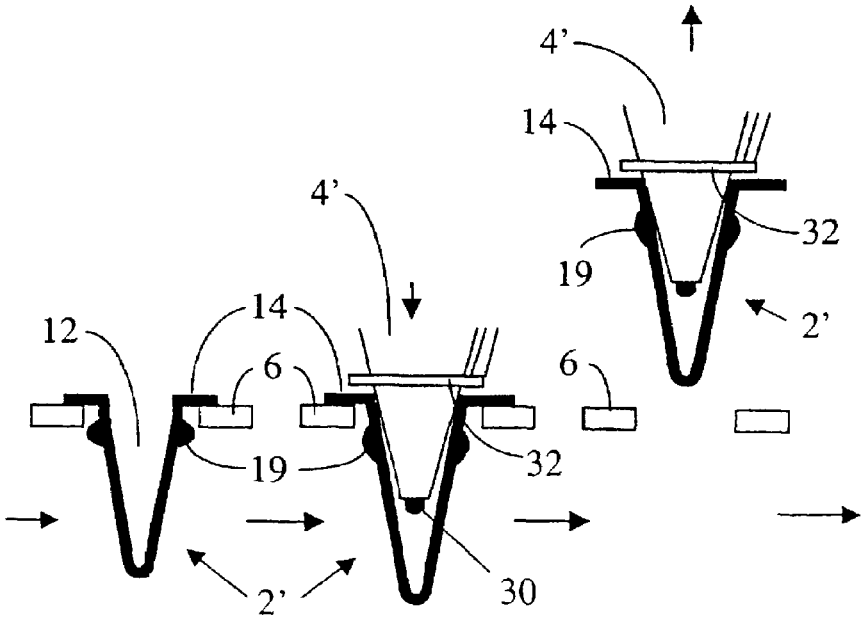

FIG. 6*a* represents a plug 2' or extendable membrane in a plug rack 6. The plug 2' according to this embodiment has, at one end, a cavity 12 and a flange 14 substantially larger than the opening 10 to be closed. The outer surface of the plug 2' is in a static state conical like said cavity 12 of the plug, hence the plug 2' of the present embodiment is substantially conical in shape. Near the flange 14 on the outer surface of the cone there is an annular boss 19, at the level of which the wall thickness of the cone surface is substantially greater than the wall thickness of the rest of the plug 2'. The purpose of the wall thickness of the boss 19 greater than the wall thickness of the other portions of the plug 2' is to function, when needed, as a seal, when the test tube 28 is closed with the plug 2'. In FIG. 6*b*, the tip of the extending device 4' has been attached to the plug 2' in the plug rack 6 by inserting the extending device 4' or the transferring device into the cavity 12 of the plug 2' in such a depth that the plug 2' is pressed around the extending device 4' so tightly that the plug 2' remains extended when attached to the extending device 4'. The extending device according to this embodiment is provided with a detaching element 32 for the plug 2' or extendable membrane.

Figures 6D, 6E, 6F, 6G:
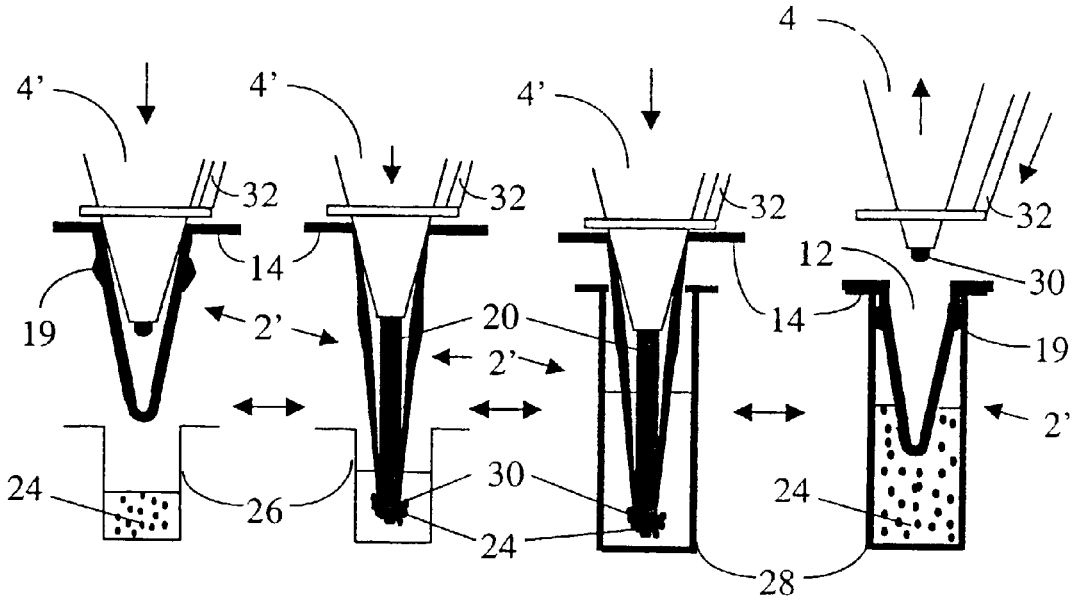

In FIG. 6*c* the plug 2' has been lifted from the plug rack 6 attached to the extending device 4'. In FIG. 6*d*, the plug 2' is inserted into a first vessel 26 containing magnetic particles 24. In FIG. 6*e*, the extending element 20 of the extending device 4' having a magnet 30 on its tip is inserted into the cavity 12 of the plug 2' so that the magnet 30 on the tip of the extending element 20 is pressed against the bottom of the cavity 12 of the plug 2' to such an extent that the outside diameter of the plug 2' is smaller than the diameter of the mouth 10 of the vessel 28 to be closed. In this case the plug 2' is extended so that the magnetic field of the magnet 30 draws the magnetic particles 24 in the vessel 26 against the extended outer wall of the plug 2'.

In FIG. 6*f*, the extended plug 2' attached to the extending device 4' and the magnetic particles 24 attached to the tip of the plug 2' by the force of the magnetic field of the magnet 30 are transferred into a second vessel 28. In FIG. 6*g*, extending has been reduced by transferring the extending element 20 and the magnet 30 on the tip thereof back inside the extending device to such an extent that the plug 2' has closed the mouth 10 of the vessel 28. At the same time, the magnetic particles 24 have been released into the liquid contained in the vessel 28 as the magnetism of the magnet 30 has ceased to draw them against the surface of the plug 2'. The plug 2 has been detached from the extending device 4' by pushing it off by means of the detaching element 32 for the plug 2' of the extending device 4'. By the steps illustrated in FIGS. 6*a*-6*g*, the magnetic particles 24 of the first vessel 26 have been transferred into the second vessel 28 and it has been closed tightly with the plug 2'.

Figures 6H, 6I, 6J, 6K:
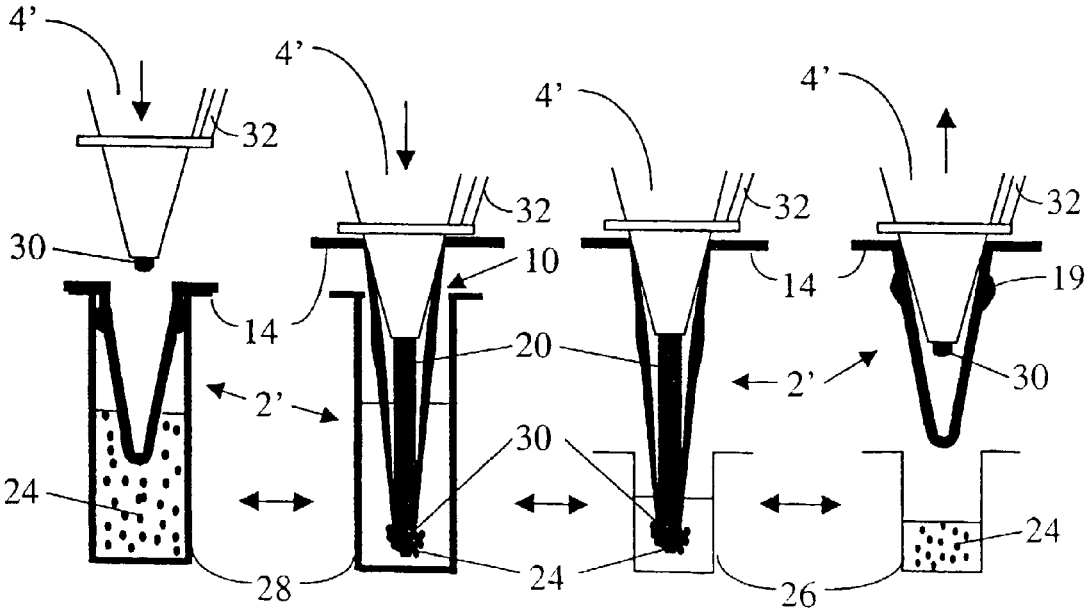

In FIG. 6*h*, the extending device 4' or the transferring device is brought again into the cavity 12 of the plug 2' after an eventual reaction or any other step performed in the vessel 28 closed by the plug 2', in order to attach it to the plug 2' by inserting the extending device 4' into the cavity 12 of the plug 2' to such an extent that the plug 2' is pressed around the extending device 4 so tightly that the plug 2', when being extended, remains in an extended state attached to the extending device 4'. In FIG. 6*i*, the extending element 20 of the extending device 4', with a magnet 30 on its tip, is inserted into the cavity 12 of the plug 2' so that the magnet 30 on the tip of the extending element 20 is pressed against the bottom of the cavity 12 of the plug 2'. The plug 2' is then extended so that the magnetic field of the magnet 30 draws the magnetic particles 24 in the vessel 28 against the extended wall of the plug 2'.

In FIG. 6*j*, the extended plug 2' attached to the extending device 4' and the magnetic particles 24 attached to the tip of the plug 2' by the force of the magnetic field of the magnet 30 are inserted into the first vessel 26 which now contains an appropriate solution for the next method step. In FIG. 6*k*, the extension has been reduced by pulling the extending element 20 and the magnet 30 on its tip back inside the extending device to such an extent that the magnet 30 on the tip of the extending element 20 has been detached from the tip of the plug 2' and the magnetic particles 24 have been released into the solution contained in the vessel 26, the magnetic force of the magnet 30 having ceased to draw them against the surface of the plug 2'. The magnetic particles 24 can be transferred, instead of the first vessel 26, into any vessel, and the vessel often is a particular vessel intended for a particular process step, which vessel has not yet been used in the previous steps.

After the steps represented in FIGS. 6*a*-6*k*, the process can be continued by applying already described steps, e.g. in accordance to the FIGS. 6*d*-6*k*, following the needs of a particular process to be performed, versatility allowing appropriate control of different reaction steps. The process steps of the FIGS. 6 can alternate in many different orders and-a particular step in the Figure is not necessarily followed by the step of the next Figure, but a step can be followed by a preceding step, e.g. 6*i* followed by 6*h*, as indicated by bidirectional arrows between the steps. Some of the steps can alternate several times, the magnetic particles can, for instance, be released in a washing liquid and recovered from it several sequential times. The extendable membrane which can be, but is not necessarily in every step, a plug according to the invention, can if needed be replaced between different steps.

In the embodiment according to FIGS. 6 is the detaching element 32 for the plug 2', which can be used both to detach the plug 2' from the extending device 4' and, if desired, to reduce extension of the extended plug 2' at the upper end of the plug 2'. According to the process described in the invention, it is advantageous to reduce the extension, at the upper end of the extended plug 2' with the aid of the detaching element 32 of said plug 2' especially when a reduction of air space or gas space in the vessel 28 to be closed is desired. In this case, extension of the extended plug 2' diminishes at the upper end of the plug 2' earlier than at its lower end, i.e. the lower end of the plug 2', in this case, barely moves upwards in the vessel 28. If, again, according to the invention, generation of negative pressure in the vessel 28 is desired in connection of closing the vessel, then tension of the stretched plug 2' is decreased by moving the extending element 20 of the extending device 4' upwards when the plug 2' already seals the mouth 10 of the vessel 28. In this way, negative pressure is achieved when the lower end of the plug 2' moves upwards due to the decrease of extension.

An extending device used in the process according to the invention can have an appropriately designed nose. The length, the thickness and the design of the nose can vary according to intended application. A separate adapter may be added thereto. The nose can be fitted with two or more nested and separately movable sleeves around the extending element. It can have different kinds of gripping means for the plug and/or an extending element which can be moved a number of distances.

The elastic plug used in the method according to the invention can be designed to be used with a special vessel or opening. The plug can have diverse depressions or protrusions as well as an outer wall of varying thicknesses. The elastic plug can be designed to be used with a special extending device.

The vessel to be used in the method according to the invention can have diverse depressions or protrusions for ameliorating the attachment of the elastic plug designed for being used therewith. The extending device, the elastic plug and the mouth of the vessel or another opening may be manufactured together and designed for being used together. In a method according to the invention a system can be used, which consists of extending devices, elastic plugs and/or vessels with a closable and/or openable mouth suitable for a particular application or applications and a particular number thereof adjusted for a particular application or applications.

In a preferred embodiment of the invention, the form of the lower end of the extending device is appropriately designed in a way enhancing the adhesive properties of the plug or membrane as to the extending device. A suitable design of the extending device may for instance consist of nodules or depressions at the lower end of the extending device to be attached to the plug. The plug to be used together with the extending device may also be designed so that it works well with nodules or depressions in the extending device.

An extending device according to the invention can also be attached or can attach itself to the plug with the aid of a special gripping element. For instance, gripping clamps, sleeves, adapters or notches can serve as such gripping elements.

The extending device may, according to the invention, be manufactured so that it allows simultaneous treatment of several separate plugs. The lower end of the device can suitably be designed in diverse forms, such as for example rodshaped, conical, wedge-shaped or angled forms. The extending element movable inside the extending device can also be appropriately designed according to intended use. The extending device may conveniently include one or more gripping elements of the same or different shapes for the plug. With the aid of an extending device having several gripping elements of the same or different shapes for the plug it is possible to treat a plug manufactured from the one and same piece and having appropriately predesigned sites for the gripping elements of the extending device. The extending device may also include a suitable number of both gripping elements and magnets suited for a magnetic treatment or for treatment of substance to be magnetised. This kind of solution allows for closing and/or opening of several openings and/or vessels simultaneously.

The moving mechanism for the extending element of the extending device can be functioned either manually or electrically. The extending element can be moved a number of distances depending on the plug and the vessel used.

The same extending device can, according to the invention, be used with quite various plugs and vessels of different designs. The range of use of the extending device can further be extended by fitting its lower end with a special adapter. The purpose of the use of adapters is, in this case, to allow treatment of plugs of quite different designs and having cavities of various inside diameters.

The application field of the invention is large, including closing or protecting and opening of various tubes, wells, vessels, containers, holes and openings.

As special cases bushings, adapters and gaskets can be mentioned, onto which, if so desired, screws, for instance, can be fixed for hanging. In this case the plug serves both as an aid for fixing and, particularly in humid rooms, for assuring waterproofness of the joint. Openings in various surfaces can thus be protected, closed, or various clamps and brackets can be fixed thereto. The plug may also have a boring, if it is appropriate in view of the purpose of use.

For instance, closing and opening of container vessels and drink packages according to the invention falls within the scope of the invention, in which case the plug to be used in the method is a simple and effective closer of vessels and packages.

The plug can be manufactured from elastic material and the vessel from inelastic material. The plug and the vessel may both be manufactured from elastic material. The elastic plug can also conveniently be designed in a manner that the plug serves for vessel as well and they with their counterparts form a closed entity. The plug can be predesigned and it may include a desired number of protrusions or depressions. The plug can be screwed and it can function as a screw cap and simultaneously be openable in accordance to the invention by means of an extending device. The plug can be, in a static state, quite varied in shape, such as, for example, a surface plate, and it can conveniently have protrusions or depressions for fixing the plug to the vessel.

The plug intended for a method according to the invention and for closing a vessel can further be covered with various protective plugs, such as screw plugs or aluminium plugs.

The invention is characterised likewise by the fact that the plug described in the invention can also function like a septum, i.e. liquids can, for instance, be transferred through the plug by a needle or a syringe. In this case, both the properties of the plug according to the invention and the properties of a septum are combined into one and the same plug.

The plug may possibly be attached to the vessel without special fixing elements, in which case the dimensional change achieved by extending is only utilised for closing the vessel.

The plug can conveniently be of different thicknesses at different sites and consequently extension will be lower or greater at given zones. The plug can also have a special border structure which fastens to or outside the lip of the vessel. The plug can be attached to the vessel by one or more separate joints. The plug can be loosened by the extending device suitably at different sites and thus a convenient fitting into the mouth of the vessel can be achieved. The plug can be loosened by the extending device suitably at different sites, thus making it possible to influence on the size of air space enclosed in the vessel. By combining ways of loosening the plug and different plugs, it is possible, with the method described in the invention, to close quite various vessels, to impact on the size of air space in the vessel, and, if needed, to create negative pressure.

The plug can be treated with various compounds when, for instance, a hydrophobic, hydrophilic, or solvent resistant surface is desired.

The vessel can conveniently have different protrusions, depressions or angles to which the plug may be suitably attached. The plug and the vessel can also be predesigned so that the attaching takes place on the outside of the vessel by means of particular fixing elements.

The invention is also adapted for use in equipments to be developed for automated closing and opening of different kinds of vessels, tubes and wells. The equipment used in the method described in the invention can also be part of an apparatus or a system suitable for any other purpose of use.

The plug according to the invention may include various reinforcements, such as metal, in its structure.

In the method according to the invention it is also possible to use auxiliary pieces with the plug, by which method additional advantages will be achieved, such as for instance additional closing for the closure made by the plug and/or additional strength to the joint between the plug and the opening to be closed.

The method according to the invention likewise allows use of adhesive materials and sealants. For instance, by using glues long lasting adhesion is achieved. In this case, the ease of fitting a protective cover or an additional seal with an adhesive surface is especially advantageous. An advantageous embodiment could also consist of using weak glue in which case the adhesive surface provides but additional fixing properties, the cover still being detachable from the object after use.

As a special case, the method in accordance with the invention for closing different kinds of openings permanently will be mentioned. In such cases, the advantage provided by the method may be the ease of fitting the plug.

The invention also finds advantageous applications particularly in immunoassays, amplification reactions and treatments of magnetic particles. With the method described in the invention and the instruments used therein advantages will be achieved which are not available when using methods of prior art. Gentle, but tight closing and opening of vessels reduces, among other things, contamination risks caused by microaerosols and liquid splashings. Minimisation of air space inside the vessels permitted by the invention provides great advantages in terms of reduction of evaporation, use of small volumes of liquids and working in high temperatures. The method described in the invention to generate negative pressure inside the vessel to be closed brings about great advantages, particularly in cases where heating of liquids is needed. For instance, in PCR reactions elevated temperatures utilised and in these cases, increase of vapour and air pressure tends to pull used vessel covers of the mouth of the vessel. Combination of the above described use of negative pressure with minimisation of air space inside the vessel to be closed is particularly advantageous when performing, for instance, PCR reactions and other amplification reactions in which elevated temperatures and small volumes of liquids are used.

Preferred applications for the method according to the invention and the extending device and the plug used therein also include in situ PCR applications. By using the method described in the invention and the instruments used therein, additions of reagents are carried off readily in in situ applications. Closing and opening of in situ vessels in order to add reagents, for instance, is in general a difficult problem. By the method disclosed in the invention closings and openings of in situ vessels can be performed simply and safely. Advantages achieved by reduction of air space inside the vessels make the use of the method according to the invention especially interesting in in situ applications. Generation by the above described method of negative pressure inside the vessel also contributes to balance vapour and air pressures generated during in situ reactions performed in high temperatures.

Concerning the method of the invention an example according to FIGS. 6 has been described above in which vessels are closed and opened according to the invention, and furthermore, substance immobilised on the microparticles is transferred from various vessels to other vessels and particles are stored in these vessels. The microparticles of the example are of magnetic or magnetisable material or the microparticles are attached to a magnetic or magnetisable body, and the microparticles on which substance has been immobilised are captured with the aid of a magnet submerged into a first vessel, the magnet along with the captured microparticles is transferred to a second vessel and the microparticles are released from the influence of the magnet. The surface of the magnet is separated from the microparticles with the aid of a plug or extendable membrane in such a way, that the extendable membrane pressed tightly against the surface of the magnet separates the magnet from the microparticles, but does not substantially weaken the magnetic field directed at the microparticles. The surface of the magnet can be pressed against the extendable membrane of the plug for capturing the microparticles, and the microparticles are releasable from the membrane of the plug when the magnet is being moved away from the plug. When extending the plug i.e. the membrane with the aid of a particular transferring device for microparticles, which transferring device can simultaneously be an extending device according to the invention, the plug can be fitted to the vessel desired to be closed. With the aid of the extending device the plug may be adequately removed and the changing of the dimensions thereof be appropriately caused so that the plug will fit in tightly to the vessel and close it. When a plug (attached) is wanted to be removed, the plug is again extended with the aid of the extending device whereupon extending of the plug changes its dimensions and the plug can thus be removed from the vessel. With the aid of the transfer and extending device, microparticles can be transferred from one vessel to another vessel or in the same vessel, and the vessel can be closed for an adequate period of time.

In the treatment of magnetic particles or magnetisable substance the method disclosed in the invention provides the user with a number of new and advantageous properties. The plug serves both as an extendable membrane separating the magnetisable substance from the transferring magnet and as a plug with which the vessel, into which the magnetic particles have been transferred, can be closed. When using the method according to the invention, no separate plugs are needed for closing the vessel. After a suitable period, when the desired reaction or settling has taken place, the plug according to the invention is released from the vessel mouth and by using the same plug as an extendable membrane separating the transferring magnet from the magnetic particles, the magnetic particles are picked up from the vessel. Thereafter, magnetic particles can be transferred again with the aid of the same plug or a new plug or membrane to other vessels and the vessels used can again, if desired, be closed by the described method. The method according to the invention and the instruments used therein will facilitate and simplify the use of magnetic particles in various applications thereof.

In a special case, the vessel and the plug to be used in the method are fully alike. The extending device changes dimensions of one piece so that it can be used as a plug for closing another plug, while the other plug functions as a vessel. In accordance with the invention, when treating magnetic particles, a similar plug can function both as a transferring element for the magnetic particles, as a vessel and as a plug for the vessel.

The extending device, which simultaneously serves as transferring device, may include a magnet which is movable up and down in an axial direction inside a tubular body thereof, the magnet being a permanent magnet, and at the lower end of the body an extendable membrane against which the surface of the permanent magnet can be pressed so as to capture the microparticles on the surface of the magnet and from which the magnetic particles can be released when the magnet is being moved away from the membrane. The membrane can be extended with the aid of the extending device to a desired extent.

As a special case of the extending device that can be mentioned are sleeves which are adequately movable within each other with the aid of which the plug or membrane can be extended. The aforesaid tool may include an up and down movable inner rod which can also be the extending device with a magnet.

The magnet can be a suitable combination of ferromagnetic material and a permanent magnet. The magnet may also be an electromagnet, in which case the magnet does not have to be moved to release the microparticles but the magnetic field is simply removed. The magnet can be adequately designed and the size thereof can vary. The transferring device can also include a number of individual magnets, and they can be separated from the microparticles by a membrane common to all of them or by individual membranes.

The microparticles are not necessarily released from the transferring device and/or the plug, but they can, for instance, be dipped in liquids contained in different vessels for a suitable period of time. Vessels can be closed with the aid of the transferring device and the extendable membrane without the treatment of the magnetic or magnetisable material.

Moving of the inner rod of the transferring device and/or regulation of the magnetic field can be executed manually or electrically.

The transferring device can include individual extending means with the aid of which the plug or membrane is attached to the vessel at particular fixing points, and individual magnets with which magnetisable material is moved.

The transferring device and the plugs or membranes to be used can even be miniaturised for treatment of extremely small vessels, membranes, or plates.

The transferring device can extend the membrane in various directions, such as horisontally and/or vertically.

The membrane or plug can be particularly designed for closing a vessel and another membrane or plug only for transferring magnetic or magnetisable materials. Aforesaid plugs or membranes can be suitably changed during the process. Microparticles can also be accumulated and/or transferred to a gel well, on different membranes, filters, glass plates, films, etc.

Vessels can vary in such a way that some of the vessels are designed to be conveniently closed with the plug and other vessels are not to be closed, and thus the plug even unextended can be inserted into the vessel and removed from it. Thus, treatments of magnetisable material and closing/opening of vessels can be advantageously combined during the process.

Microparticles are, for instance of paramagnetic, supermagnetic, ferromagnetic material or latex particles.

According to the invention, the transferring device and membranes allow even for treatments of various bodies to which, for instance, antibodies, antigens, polynucleotides, or polypeptides have been bound. Bodies may be for example plateshaped and they may be of plastic, glass, or metal. The body advantageously comprises a number of different zones to which aforesaid factors have been bound. The body can be incubated with various samples and/or solutions whereupon events known e.g. from immunoassays or hybridisation reactions take place. The body can also be treated with different marker reagents, such as, for instance, luminescent or fluorescent markers. The body can also be treated into a state where it can be measured e.g. by luminometric or fluorometric methods. Preferably, the body includes hundreds or even thousands of different areas which can be treated simultaneously by using the method according to the invention. As examples, diagnostic multiparametric determinations or treatments of cDNA libraries and assays can be mentioned. There can be a plurality of bodies, and they can be treated with individual instruments having a transferring device or several transferring devices according to the invention. The body includes a zone of magnetic or ferromagnetic material and consequently the body can be moved by a transferring device described in the invention. In accordance with the invention, the body in question can be transferred from one vessel to another vessel and, if desired, vessels can be closed for adequate periods of time.

The method according to the invention can be automatised to comprise a desired number of treatments of magnetic or magnetisable materials, closings and openings of vessels.

A vessel tray can be closed with a common membrane in such a way that there is no physical obstruction between the distinctive wells, and in such a case the function of the membrane may be, for instance, to prevent liberation of microaerosols and evaporation of liquids.

With the method of the invention, it is possible to perform for instance PCR reactions, other amplification reactions and immunoassays in a controlled way in a closed environment. A vessel tray including a desired number of wells of different sizes is closed with the aid of the extending device and other instruments disclosed in the invention. Desired liquids and microparticles may have been previously dosed into the wells. The wells can contain different solutions, such as for instance wash liquids, buffers, magnetic particles, nucleotides, antibodies, markers, and enzymes. When magnetic or magnetisable material is desired to be transferred from one vessel to a second vessel in a closed environment, a membrane-protected magnet can be transferred by the transferring device and the extendable membrane from one vessel to a second vessel and the magnetisable material can thus be conveniently released into the vessels. In this case the membrane does not need to be removed from upon the vessel tray as the elasticity of the membrane allows for transferring magnetisable material between different wells of the closed vessel. Desired factors such as for example enzymes, oligonucleotides, streptavidin, DNA probes, and antibodies, can be immobilised on the magnetic material. The magnetic material can also bind for instance DNA, mRNA, DNA probes and amplification products.

The wells or a part of the wells of the vessel tray can be prefilled with desired solutions, and they can have an appropriate cover such as aluminium foil or another film. When opening the above mentioned predosed and closed vessel tray by the method according to the invention, the transferring device can be used to pierce the aluminium foil, for example, and thus have the solutions ready for use.

Solutions can be taken by means of a needle/syringe from the closed vessel tray, or solution can be inserted into the vessel by a needle/syringe, i.e. the membrane serves here as a septum. The liquids in the wells or a part thereof can be covered for instance with oil to prevent evaporation.

The vessel tray can be placed into specially designed thermocyclers or it can be used in automatised equipments. The vessel tray can also be designed so that it is possible to perform—without opening the vessel tray in question—for instance photometric, fluorometric, or luminometric assays thereon.

The membrane can be conveniently predesigned to include different protrusions, depressions, or angles so as to achieve an appropriate detachment and to facilitate the treatment of microparticles in the above mentioned closed environment.

It is obvious to those skilled in the art that the invention is not limited to what is described above, but it can be varied within the scope of the appended claims.

The invention claimed is:

1. A method for closing an opening, comprising a) providing a plug of elastic material, an outside diameter ($r_L$) of the plug in a static state being larger than a diameter ($r_p$) of the opening to be closed, and which plug has, at its end, a cavity and optionally a flange, protrusion or groove, the diameter of which is substantially larger than the diameter ($r_p$) of the opening to be closed, b) releasably attaching an extending device to the plug, wherein the extending device comprises an extending element that can be moved between an extended and a retracted position i) by inserting the extending device into the cavity of the plug to such an extent that the plug is stretched to a first stretched position in which the plug is pressed around the extending device so tightly that the plug remains releasably attached to the extending device, or ii) by gripping the flange, protrusion or groove of the plug with a gripping means of the extending device, c) in a separate step subsequent to step b), stretching the plug to a second stretched position by moving said extending element to its extended position, such that the plug's outside diameter ($r_V$) becomes smaller than the diameter ($r_p$) of the opening to be closed, d) inserting the extended plug into the opening to be closed, and e) reducing the plug's extension to such an extent that the plug closes the opening and adheres to it so tightly that the extending device is removed from the plug i) either by pulling, or ii) by means of a detaching element of the plug associated with the extending device.

2. A method for opening of an opening closed with a plug of elastic material, an outside diameter ($r_L$) of the plug in a static state being larger than a diameter ($r_p$) of the opening, and which plug has, at its end, a cavity, and optionally a flange, protrusion or groove, the diameter of which is substantially greater than the diameter ($r_p$) of the closed opening, comprising a) releasably attaching an extending device to the plug, wherein the extending device comprises an extending element that can be moved between an extended and a retracted position i) by inserting the extending device into the cavity of the plug closing the opening to such an extent that the plug is stretched to a first stretched position in which the plug is pressed around the extending device so tightly that the plug remains releasably attached to the extending device, or ii) by gripping the flange, protrusion or groove of the plug closing the opening with a gripping means of the extending device, b) stretching the plug to a second stretched position by moving said extending element to its extended position, such that the outside diameter of the plug becomes smaller than the diameter ($r_p$) of the closed opening, and c) removing the extended plug from the closed opening.

3. The method of claim 1, wherein a cross-sectional area of the cavity of said plug shrinks when the plug is stretched to said first stretched position.

4. The method of claim 1, wherein said plug has the flange, protrusion or groove, adapted to be grasped by gripping elements of the extending device.

5. The method of claim 1, wherein said opening is a) a mouth of a laboratory vessel selected from the group consisting of a test tube, a flask and a well of a multiwell plate, b) a mouth of a vessel adapted to store or ship foodstuffs, c) an opening of a container selected from the group consisting of a filling opening, a discharge opening, an air vent and an inspection opening, or d) an opening in a partition selected from the group consisting of a wall, a floor, and a ceiling.

6. The method of claim 1, wherein said elastic material of said plug is a member selected from the group consisting of silicone rubber, caoutchouc, fluorosilicon, fluoroelastomer, perfluoroelastomer, polyurethane, polychloroprene, styrene butadiene and ethylene propylene.

7. The method of claim 1, wherein said plug has a substantially cylindrical or conical casing, and a thickness and/or shape of the wall between the plug cavity and its substantially cylindrical or conical casing varies at different points so that a) the outer casing of the plug has a portion protruding outwards from the casing, said portion serving as an annular reinforcement and/or a shape which seals the unextended plug squeezed inside the opening and/or b) the wall thickness of the plug is adapted to be in some portions thinner and/or thicker than the rest of the wall of the plug.

8. The method of claim 7, wherein the plug at first closes the opening tightly and only then, extension being further reduced, withdraws from the air or gas space of the vessel to be closed in such a way that the inner volume of the closed vessel increases and negative pressure is generated in the vessel.

9. The method of claim 8, wherein negative pressure is generated in the vessel by the plug a) in the opening to be closed, when the opening is being closed by reducing the extension of the plug by the extending device, and/or b) because of the deformation caused by detaching of the plug by the detaching element of the extending device.

10. The method of claim 1, wherein said plug is adapted so that a second, similar plug acts as the vessel to be closed, in which case the opening to be closed is the mouth of the cavity of said second, similar plug.

11. The method of claim 1, wherein the extending device acts, at the same time, as a transferring device adapted for capturing and releasing magnetic or magnetizable microparticles binding immobilized substance, the transferring device comprising a magnet, and the plug acts, at the same time, as an extendable membrane so that the membrane attached tightly against the surface of the magnet separates the magnet from the microparticles, but does not substantially weaken the magnetic field exerted to the microparticles.

12. The method of claim 2, wherein a cross-sectional area of the cavity of said plug shrinks when the plug is stretched to said first stretched position.

13. The method of claim 2, wherein said plug has the flange, protrusion or groove, adapted to be grasped by gripping elements of the extending device.

14. The method of claim 2, wherein said opening is a) a mouth of a laboratory vessel selected from the group consisting of a test tube, a flask and a well of a multiwell plate, b) a mouth of a vessel adapted to store or ship foodstuffs, c) an opening of a container selected from the group consisting of a filling opening, a discharge opening, an air vent and an inspection opening, or d) an opening in a partition selected from the group consisting of a wall, a floor, and a ceiling.

15. The method of claim 2, wherein said elastic material of said plug is a member selected from the group consisting of silicone rubber, caoutchouc, fluorosilicon, fluoroelastomer, perfluoroelastomer, polyurethane, polychloroprene, styrene butadiene and ethylene propylene.

16. The method of claim 2, wherein said plug has a substantially cylindrical or conical casing, and a thickness and/or shape of the wall between the plug cavity and its substantially cylindrical or conical casing varies at different points so that a) the outer casing of the plug has a portion protruding outwards from the casing, said portion serving as an annular reinforcement and/or a shape which seals the unextended plug squeezed inside the opening and/or b) the wall thickness of the plug is adapted to be in some portions thinner and/or thicker than the rest of the wall of the plug.

17. The method of claim 16, wherein the plug at first closes the opening tightly and only then, extension being further reduced, withdraws from the air or gas space of the vessel to be closed in such a way that the inner volume of the closed vessel increases and negative pressure is generated in the vessel.

18. The method of claim 17, wherein negative pressure is generated in the vessel by the plug a) in the opening to be closed, when the opening is being closed by reducing the extension of the plug by the extending device, and/or b) because of the deformation caused by detaching of the plug by the detaching element of the extending device.

19. The method of claim 2, wherein said plug is adapted so that a second, similar plug acts as the vessel to be closed, in which case the opening to be closed is the mouth of the cavity of said second, similar plug.

20. The method of claim 2, wherein the extending device acts, at the same time, as a transferring device adapted for capturing and releasing magnetic or magnetizable microparticles binding immobilized substance, the transferring device comprising a magnet, and the plug acts, at the same time, as an extendable membrane so that the membrane attached tightly against the surface of the magnet separates the magnet from the microparticles, but does not substantially weaken the magnetic field exerted to the microparticles.

21. The method of claim 2, further comprising d) reducing the plug's extension to such an extent that the extending device is detached from the plug i) either by pulling, or ii) by means of a detaching element for the plug associated with the extending device.

* * * * *